United States Patent [19]

Leikert et al.

[11] Patent Number: 4,551,090

[45] Date of Patent: Nov. 5, 1985

[54] BURNER

[75] Inventors: Klaus Leikert; Gerhard Büttner; Sigfrid Michelfelder, all of Gummersbach, Fed. Rep. of Germany

[73] Assignee: L. & C. Steinmüller GmbH, Gummersbach, Fed. Rep. of Germany

[21] Appl. No.: 562,848

[22] Filed: Dec. 19, 1983

Related U.S. Application Data

[63] Continuation of Ser. No. 180,706, Aug. 25, 1980, abandoned.

[51] Int. Cl.[4] ..... F23M 9/00

[52] U.S. Cl. ..... 431/188; 431/182; 431/284; 431/10; 110/265

[58] Field of Search ..... 431/10, 182, 185, 186, 431/187, 188, 190, 284, 285; 110/260, 261, 262, 263, 264, 265

[56] References Cited

U.S. PATENT DOCUMENTS

| | | | |
|---|---|---|---|
| 2,335,188 | 11/1943 | Kennedy | 431/284 |
| 3,822,654 | 7/1974 | Ghelfi | 431/284 |
| 4,230,445 | 10/1980 | Janssen | 431/351 |

FOREIGN PATENT DOCUMENTS

| | | | |
|---|---|---|---|
| 1060082 | 6/1959 | Fed. Rep. of Germany | 431/188 |
| 52-26024 | 2/1977 | Japan | 431/10 |
| 885376 | 12/1961 | United Kingdom | 110/262 |

*Primary Examiner*—Margaret A. Focarino
*Attorney, Agent, or Firm*—Becker & Becker, Inc.

[57] ABSTRACT

A burner for combustion of nitrogen-containing fuels. The burner includes a core-air tube with centrally arranged oil atomizing lance, a dust tube surrounding the core-air tube, a mantle-air tube which surrounds the dust tube and is provided with an axially shiftable twist-blade ring arranged at the air inlet, as well as a burner opening which expands conically toward the combustion chamber. The core-air tube and the mantle-air tube are supplied from a main air conduit. Air jets or nozzles are provided in a concentric arrangement around the burner opening. These air nozzles are connected with the main air passage by conduits, and the air stream discharging from the air nozzles is regulated by a flap.

4 Claims, 2 Drawing Figures

BURNER

Figures 1, 2:
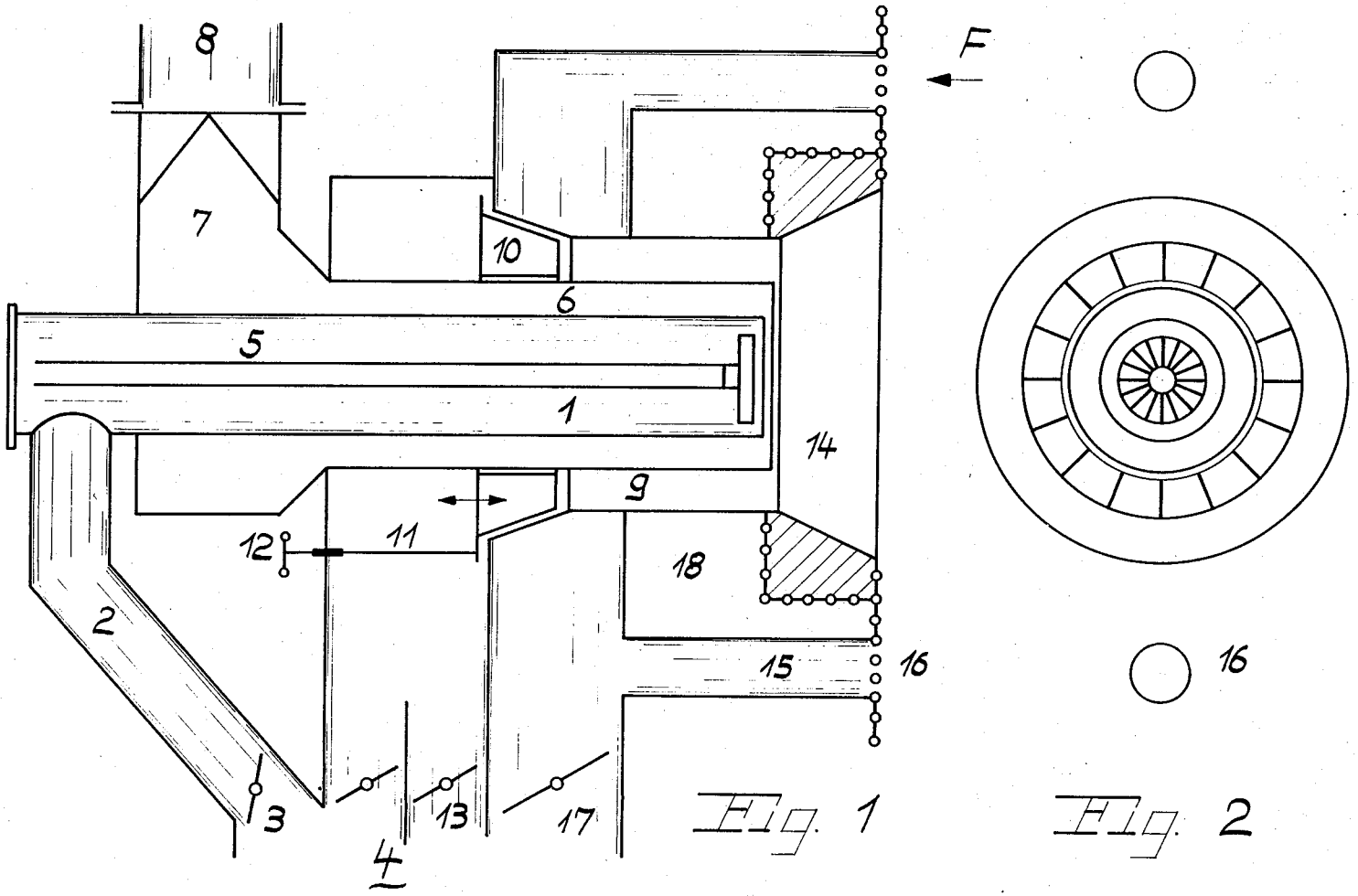

This is a straight continuation of co-pending parent application Ser. No. 180,706—Leikert et al, filed Aug. 25, 1980, now abandoned.

The present invention relates to a burner for burning nitrogen-containing fuels. The burner comprises a core-air tube having a centrally arranged oil atomizing lance, a dust tube surrounding the core-air tube, a mantle-air tube which surrounds the dust tube and is provided with an axially shiftable twist blade ring arranged at the air inlet, as well as a burner opening which widens conically toward the combustion chamber, with the core-air tube and the mantle-air tube being supplied from a main air conduit.

Burners with the aforementioned structural features generate flames which in turn generate a considerable concentration of $NO_x$ in the flue gases. The reaction mechanisms causing the formation of nitrogen oxides in technical combustion are mostly known. At the present, there are essentially two different formation reactions as follows:

(1) the thermic $NO_x$ formation, which is based upon oxidation of molecular nitrogen, which occurs for instance amply in the combustion air. Since the oxidation of molecular nitrogen requires atomic oxygen or aggressive radicals (for instance OH, $O_3$, etc.), such oxidation is strongly dependent upon temperature, thus thermic $NO_x$; and (2) the formation of fuel $NO_x$which occurs by oxidation of nitrogen compounds bound in the fuel. During the pyrolysis, nitrogen-carbon and nitrogen-hydrogen radicals (CH, HCN, CH, etc.) form from these nitrogen compounds. These radicals oxidize to form $NO_x$ already at relatively low temperatures in the presence of oxygen because of their reactivity with molecular oxygen.

A reduction of the thermic $NO_x$-formation is accordingly primarily obtained by lowering the combustion temperature and the retention times at high temperatures. Since with the combustion of fuels with bound nitrogen, however, a large portion of the total $NO_x$-formation results from the fuel-$NO_x$-reaction, the aforementioned measures with such fuels are not sufficient for complying with the emission standards existing in certain countries. For this purpose, it is necessary to reduce the nitrogen compounds into molecular nitrogen ($N_2$) still during the pyrolysis in the presence of oxygen. Tests have shown that these reduction reactions to molecular nitrogen occur, for instance, when the fuels are burned at below-stoichiometric conditions, that is, with less oxygen addition or air addition than necessary for complete combustion. To achieve optimum results, an air ratio between 0.9 and 0.5 is selected for the primary combustion zone as a function of the limiting or edge conditions (for instance wall temperature of the combustion chamber). However, to achieve a complete combustion of the carbon-hydrogen compounds of the fuel, the reaction products resulting in the below-stoichiometric primary region must then be afterburned.

Tests have shown that which such a two-step combustion, both the fuel-$NO_x$-formation (with simultaneous heat removal from the below-stoichiometric region) as well as the thermic $NO_x$-formation can be considerably reduced. In tests utilizing the two-step combustion, the $NO_x$-emission values were reduced approximately up to 70% compared with un-stepped combustion.

By tests it was proven that the formation of fuel $NO_x$ could be clearly reduced by operating the burner in the near-stoichiometric or below-stoichiometric range. In order to avoid losses through incomplete combustion, and to avoid increase of other noxious material emissions (CO, hydrocarbons, and particles), additional air must be blow in above the burners in the combustion chamber during below-stoichiometric operation of the burners. The disadvantage of this manner of operation is that in the below-stoichiometrically operated lower part of the combustion chamber, sintering and corrosion of the tube walls can occur. Accordingly, the operational reliability of the system is in danger.

It has furthermore been determined that by slowing the mixture between air flow and fuel flow, likewise considerable reduction of $NO_x$-emission can be achieved. For this purpose, flow or spray burners, for instance, are suitable, with which both the air stream and the fuel stream are blown in parallel into the combustion chamber. To achieve a satisfactory ignition, the burner streams must, however, support each other, for instance in a corner firing or combustion.

With the arrangement of the burners in a front- or counter-firing or combustion, the mixture of air and fuel can, for example, be slowed thereby that the secondary air surrounding the dust stream is blown-in at substantially the same speed.

In a known burner, the secondary air flow or stream is added separately in two tubes, which are arranged annularly with respect to each other, to permit discharge of, for example, the inner secondary air stream, with a low speed, directly adjoining the dust stream, and of the outer secondary air stream with higher speed. Disadvantageous with this arrangement is that an extension of the flame occurs, which has as a consequence larger combustion chambers, and that with the load-conditioned reduction of the secondary air, the speed of the secondary air is reduced below the dust-air speed, whereby the character and shape of the flame change. The ignition could also be disadvantageously influenced hereby.

Furthermore, it is known to undertake a primary combustion at below-stoichiometric conditions in an antechamber of the combustion chamber, and to admix the air necessary for complete combustion with the combustion gases which leave the antechamber. The disadvantage of this arrangement exists in the danger of tube wall corrosion of the antechamber which is operated below-stoichiometric condition.

It is therefore an object of the present invention to develop a burner with which, by influencing the secondary air flow and introducing the same at different locations of the combustion chamber, yet always in association with the burner, the combustion is influenced in such a manner that in a primary zone or partial combustion zone directly adjoining the burner outlet there is obtained a stable ignition over the entire load range at under-stoichiometric conditions, and in a secondary zone or afterburning zone adjoining the primary zone the remainder or balance of the combustion occurs at above-stoichiometric conditions.

This object, and other objects and advantages of the present invention, will appear more clearly from the following specification in connection with the accompanying drawing, in which:

FIG. 1 is a longitudinal section through a burner according to the present inventive principle; and FIG. 2 is a view of the burner in the direction of arrow F in FIG. 1.

The burner according to the present invention is characterized primarily in that air nozzles or jets are provided in a concentric arrangement around the burner opening; these air nozzles are connected with the main air passage by conduits, and the air flow leaving these air nozzles is regulated by a flap.

In accordance with a further embodiment of the present invention, the air nozzles can be embodied as hole-type nozzles or as air jets (slotted nozzles), whereby, for instance, the slot-like openings are produced by removal of the fins or blades between the tubes.

In another embodiment of the present invention, it is further proposed that at least two air nozzles, with a maximum of six air nozzles, be arranged in a divided or graduated circle, which may be located concentrically with respect to the mantle-air tube, the divided circle diameter being at least 1.5 times, with a maximum of 3 times, the diameter of the mantle-air tube.

The advantages obtained with the present invention consist in that by adding to the combustion chamber a part of the secondary air by means of air nozzles located externally of the mantle-air tube of the burner, the combustion procedure of the fuel, which contains nitrogen and passes to the combustion, occurs in such a manner that the $NO_x$-values are reduced to a minimum without thereby endangering the ignition of the burner over the entire load range, without sintering and corrosion resulting on the combustion chamber tubes, and without the combustion being impaired.

Referring now to the drawing in detail, the burner comprises a central core-air tube 1 which is suitable for receiving an oil atomizing lance 5 for ignition firing or for alternative power combustion for oil. The core-air tube 1 is connected with the main air passage or conduit 4 by the passage or conduit 2 and the flap or valve 3. The dust-air tube 6 is arranged coaxial to the core-air tube 1, and is connected to the dust conduit 8 by the dust distributing chamber 7. The dust-air tube 6 is supplied by a coal-dust tube with the dust-air mixture for combustion. A mantle-air tube 9 is arranged coaxially around the dust-air tube 6, and is connected by flaps 13 with the main air conduit 4. A twist-blade ring 10, through which the mantle air flows axially, can be shifted axially by several spindles 11 and the hand wheel 12. The mantle-air passage 9 is connected with the combustion chamber by the conically expanding burner chalice or opening 14. Stepped-air nozzles or jets 16 are supplied with air from the main air conduit 4 by several conduits 15. These stepped-air jets or nozzles 16 are uniformly distributed over an imaginary divided circle of the burner periphery. The burner opening 14 is made, for example, of a ceramic mass, and is built into a tube basket 18 which is formed from the tubes of the wall tubing of the combustion chamber.

The stepped-air nozzles or jets 16 can be embodied either as hole-type nozzles 16, or as slotted nozzles or jets (air jets). The air jets result from removal of the tubing of the combustion chamber wall formed of a pipe-web-pipe configuration. The stepped-air flow, which passes into the combustion chamber through the conduit 15 with the nozzles or jets 16, is regulated by a flap 17.

The present invention is, of course, in no way restricted to the specification and drawing, but also encompasses any modifications within the scope of the appended claims.

What we claim is:

1. A burner for combustion of fuel which contains nitrogen and for which purpose, said burner comprises in combination therewith:

a main air supply conduit;

a core-air tube which is in communication with said main air conduit;

an oil atomizing lance centrally arranged in said core-air tube;

a dust tube which surrounds at least a part of said core-air tube;

a mantle-air tube which surrounds at least a part of said dust tube and is provided with an air inlet which is in communication with said main air supply conduit, said mantle-air tube being connected to and in communication with a burner opening which widens conically from said mantle-air tube toward a combustion chamber;

an axially shiftable twist blade ring arranged in said air inlet of said mantle-air tube and arranged as a twist producer essentially only for the mantle-air although adjustable axially;

at least two and up to a maximum of only six air nozzles concentrically arranged around said burner opening, said two to six air nozzles being in communication with said main air supply conduit, said two to six air nozzles being arranged in a divided circle having a diameter in a range between minimum 1.5 and maximum 3 times the diameter of said mantle-air tube so that air flow supplied therewith is axially parallel and subdivided into a mantle-air flow and a stepped-air flow as supplied therewith; and a flap for regulating the air flow through said two to only six air nozzles such that tertiary air is added axially parallel to the axis of the main flame and such that subdividing of tertiary air is kept from being too great because otherwise impulse, which in remaining or tertiary air divided into too great a number of partial flows, is insufficient in order to bring remaining or tertiary air sufficiently far into the combustion chamber, which means accordingly to bring oxygen to a location where oxygen is needed to attain an influence upon $NO_x$-reduction.

2. A burner in combination according to claim 1, in which said two to only six air nozzles are hole-type nozzles.

3. A burner in combination according to claim 1, in which said two to only six air nozzles are slotted nozzles.

4. In combination with a burner for combustion of fuel which contains nitrogen, said burner being provided with:

a main air supply conduit;

a core-air tube which is in communication with said main air supply conduit;

an oil atomizing lance centrally arranged in said core-air tube;

a dust tube which surrounds at least a part of said core-air tube;

a mantle-air tube which surrounds at least a part of said dust tube and which is provided with an air inlet that is in communication with said main air supply conduit, said mantle-air tube being connected to and in communication with a burner opening which widens conically from said mantle-air tube toward a combustion chamber; and the improvement in combination therewith comprising:

an axially shiftable twist blade ring arranged in said air inlet of said mantle-air tube and arranged as a twist producer essentially only for the mantle-air although adjustable axially via spindles and a handwheel operatively associated therewith;

at least two and up to a maximum of only six air nozzles concentrically arranged around said burner opening, said two to six air nozzles being in communication with said main air supply conduit, said two to six air nozzles being arranged in a divided circle having a diameter in a range between 1.5 and 3 times the diameter of said mantle-air tube so that secondary air flow supplied therewith is axially parallel and subdivided into a mantle-air flow and a stepped-air flow as supplied therewith; and a flap for regulating the air flow through said two to only six air nozzles such that tertiary air is added axially parallel to the axis of the main flame and such that subdividing of tertiary air is kept from being too great because otherwise impulse, which in remaining or tertiary air divided into too great a number of partial flows, is insufficient in order to bring remaining or tertiary air sufficiently far into the combustion chamber, which means accordingly to bring oxygen to a location where oxygen is needed to attain an influence upon $NO_x$-reduction.

* * * * *